United States Patent [19]

Chapin et al.

[11] Patent Number: 4,575,173

[45] Date of Patent: Mar. 11, 1986

[54] INSULATION DISPLACEMENT TERMINAL

[75] Inventors: Melodee A. Chapin, Cortland; Charles R. Nestor, Niles; William E. Cross, Brookfield, all of Ohio

[73] Assignee: General Motors Corporation, Detroit, Mich.

[21] Appl. No.: 683,341

[22] Filed: Dec. 19, 1984

[51] Int. Cl.[4] ..... H01R 4/24

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 899,708 | 9/1908 | Ball | 339/97 R |
| 3,395,381 | 7/1968 | Huffnagle | 339/97 C |
| 3,845,455 | 10/1974 | Shoemaker | 339/97 R |
| 3,926,498 | 12/1975 | Hoppe, Jr. | 339/97 R |
| 4,097,107 | 6/1978 | Hawkins | 339/97 R |
| 4,324,450 | 4/1982 | Weisenburger | 339/97 R |
| 4,348,072 | 9/1982 | Gudaitis et al. | 339/97 R |
| 4,385,794 | 5/1983 | Lucius | 339/97 R |

*Primary Examiner*—Joseph H. McGlynn

*Attorney, Agent, or Firm*—Francis J. Fodale

[57] ABSTRACT

An insulation displacement terminal comprises a base having a pair of integrally connected side members. Each side member has slotted end plates which are juxtaposed the respective slotted end plates of the other side member to form two pairs of longitudinally spaced plates having cooperating slots which impart a scissors-like action against the conductive core of an insulated electrical conductor which has its insulation pierced as it is forced into the slots.

2 Claims, 5 Drawing Figures

INSULATION DISPLACEMENT TERMINAL

This invention relates generally to insulation displacement terminals and, more particularly, to insulation displacement terminals comprising a pair of juxtaposed, relatively moveable, slotted plates which receive an insulated electrical conductor parallel to its axis and impart a scissors-like action to pierce the insulation of the insulated electrical conductor.

It is already known from U.S. Pat. No. 4,097,107 granted to Harold G. Hawkins on June 27, 1978 and pending U.S. patent application Ser. No. 498,402, filed May 26, 1983, to provide an insulation displacement terminal of the above noted "scissors action" type.

The object of our invention is to provide an improved insulation displacement terminal of the "scissors-action" type. A significant feature of our invention is that the insulation displacement terminal is narrow and therefore a member of terminals may be used side by side on close centerlines.

Another feature of our invention is that an insulated electrical conductor is disposed parallel to the base of the insulation displacement terminal and consequently the terminal is suitable for in-line applications.

Another feature of our invention is that the terminal has two pairs of "scissors-like" slotted plates.

Another feature of our invention is that the terminal establishes at least four point contact with the conductor core and may establish as much as eight point contact with the conductive core.

Other objects and features of the invention will become apparent to those skilled in the art as the disclosure is made in the following detailed description of a preferred embodiment of the invention as illustrated in the accompanying sheet of drawing in which.

Figure 1:
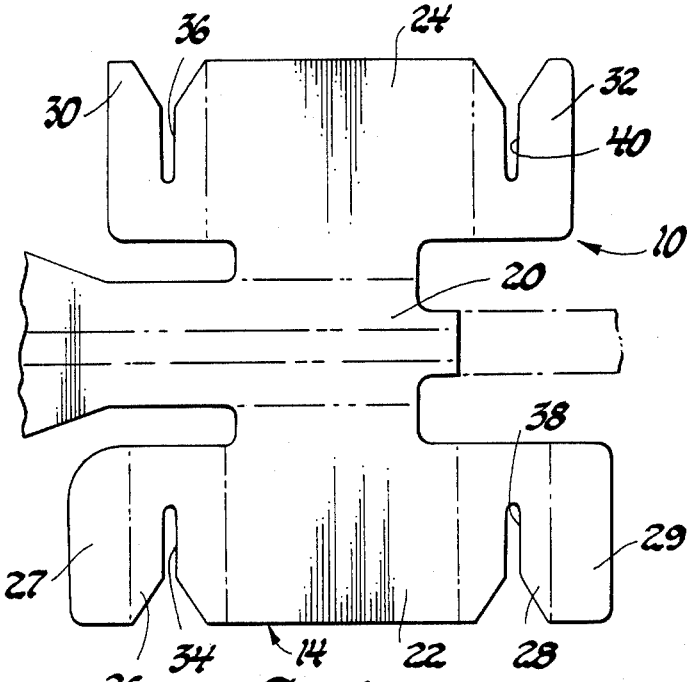
FIG. 1 is a plan view of a stamped sheet metal blank for constructing an insulation displacement terminal in accordance with our invention.
Figure 2:
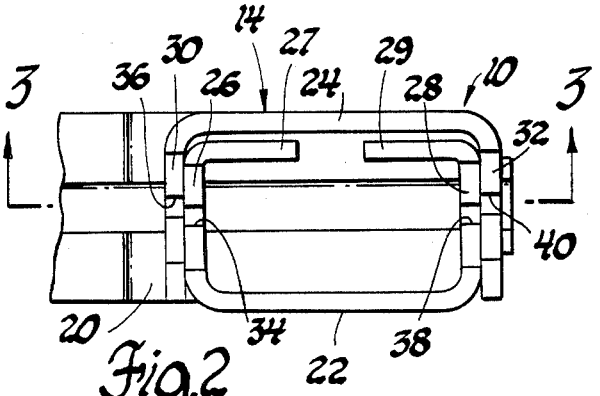
FIG. 2 is a top view of an insulation displacement terminal made from the stamped sheet metal blank shown in FIG. 1.
Figure 4:
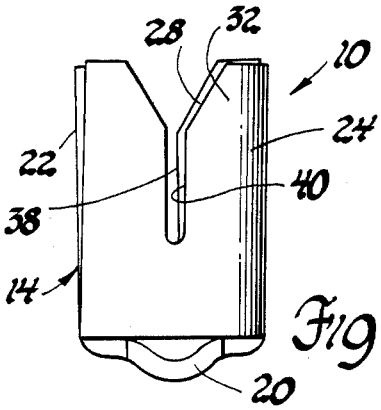
FIG. 4 is an end view of the insulation displacement terminal shown in FIG. 2.
Figure 3:
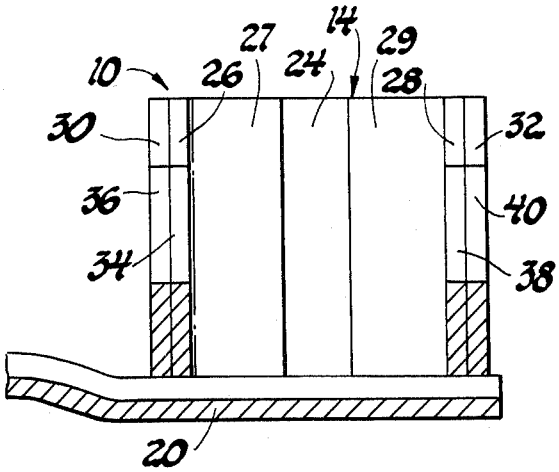
FIG. 3 is a longitudinal section taken substantially along the line 3—3 of FIG. 2 looking in the direction of the arrows.
Figure 5:
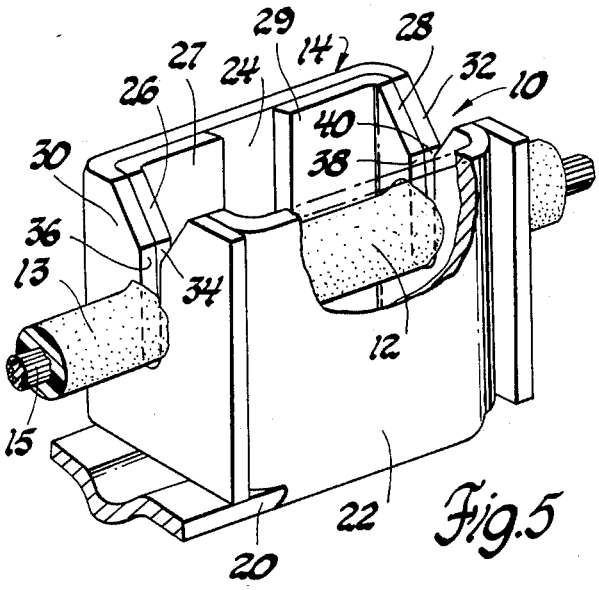
FIG. 5 is a perspective view of the insulation displacement terminal attached to an insulated conductor.

Referring now to the drawing, our invention is illustrated in conjunction with an insulation displacement terminal 10 for connecting an insulated electrical conductor 12 to another electric component of any type. Consequently, the contact portion of the terminal is not shown. It should be understood, however, that our invention can be utilized with any type of the contact portion such as a socket, a blade, a pin, a ring or any other suitable structure for making an electrical contact with another electrical device or mating terminal.

Our invention is concerned with the insulation displacement portion of the terminal 10 indicated generally at 14. In this regard, the terminal 10 comprises a base 20 having a pair of laterally spaced side members 22 and 24 integrally connected to the opposite longitudinal sides of the base 20. The side members 22,24 are bent up with respect to the base 20 forming respective bights so that the side members 22,24 are spaced apart and confront each other.

The side member 22 has slotted plates 26, 28 integrally connected at its opposite longitudinal ends by respective bights so that the slotted plates 26, 28 extend toward the side member 24. Integral flanges 27, 29 are attached to the ends of the slotted plates 26, 28 by bights so that the flanges extend inwardly toward each other and are engageable with the side member 24.

The side member 24 on the other hand has slotted end plates 30, 32 integrally connected at its opposite longitudinal ends by respective bights so that the slotted end plates 30, 32 extend toward the side member 22 and are juxtaposed outwardly of the slotted plates 26, 28 respectively.

The slotted plates 26, 30 have slots 34, 36 which are open at the edge of the plate remote from the base 20 and which are offset in the transverse direction so that each of the side members 22, 24 is pivoted toward the opposite side member and against the bias of the bight connecting it to the base 20 when the insulated electrical conductor 12 is forced into the slots 34, 36 to pierce the insulation 13. Consequently the slotted plates 26, 30 impart a scissors like action against the conductive core 15.

The slotted plates 28, 32 similiarly have slots 38, 40 which are open at the edge of the plate remote from the base 20 and which are offset in the transverse direction so that the slotted plates 28, 32 also impart a scissors like action against the conductive core 15 of the insulated electrical conductor 12 when it is forced into the slots 38, 40.

Thus the terminal 10 has two longitudinally spaced pairs of slotted plates 26, 30 and 28, 32 which have cooperating slots for piercing the insulation 13 of the insulated electrical conductor 12 and engaging the conductive core 15 with a scissors like action thus assuring at least four point contact between the terminal 10 and the conductive core 15.

The slots 34, 36, 38, and 40, however, are all preferably narrower than the conductive core 15 so that as many as eight points of contact are established and maintained. The flanges 27, 29 engage the side member 24 to prevent permanent deformation of the bights connecting the side members 22, 24 to the base 20 when the side members 22, 24 are pivoted toward each other as the insulated electrical conductor 12 is forced into the slots 34, 36, 38, and 40.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An insulation displacement terminal for piercing the insulation of an insulated electrical conductor and making contact with the conductive core comprising, a base member having first and second side members connected to opposite longitudinal sides of the base member by respective bights so that the side members are spaced apart and confront each other, first and second slotted plates connected at opposite longitudinal ends of the first side member by respective bights so that the first and second slotted plates extend toward the second side member, and third and fourth slotted plates connected at opposite longitudiunal ends of the second side member by respective bights so that the third and fourth slotted end plates are juxtaposed the first and second slotted plates respectively, to form two longitudinally spaced pairs of plates having cooperating slots which impart a scissors-like action against an insulated electrical conductor forced into the cooperating slots.

2. An insulation displacement terminal for piercing the insulation of an insulated electrical conductor and making contact with the conductive core comprising, a base member having first and second side members connected to opposite longitudinal sides of the base member by respective bights so that the side members are spaced apart and confront each other, first and second slotted plates connected at opposite longitudinal ends of the first side member by respective bights so that the first and second slotted plates extend toward the second side member, third and fourth slotted plates connected at opposite longitudiunal ends of the second side member by respective bights so that the third and fourth slotted plates are outwardly juxtaposed the first and second slotted plates respectively, said first and second slotted plates having slots which are open at an edge remote from said base and narrower than the conductive core of an insulated electrical conductor to be forced into the slots, and said third and fourth slotted plates also having slots which are open at the edge remote from the base and narrower than the conductive core, the slots of the first and second slotted plates being offset with respect to the slots of the third and fourth slotted plates so that the side members are pivoted toward each other when the insulated electrical conductor is forced into the slots whereby the two longitudinally spaced pairs of plates have cooperating slots which impart a scissors-like action against the insulated electrical conductor forced into the cooperating slots, and flanges at the ends of the first and second slotted plates for engagging the second side member to prevent permanent deformation when the side members are pivoted toward each other against the bias of the respective bights connecting them to the base.

* * * * *